US005219514A

United States Patent [19]

Blostein et al.

[11] Patent Number: 5,219,514

[45] Date of Patent: Jun. 15, 1993

[54] TUNDISH FOR THE CONTINUOUS CASTING OF STEEL

[75] Inventors: Philippe Blostein, Meudon; Pierre Charlery-Adele, Maurepas, both of France

[73] Assignee: L'Air Liquide, Societe Anonyme pour l'Etude et l'Exploitation des Procedes Georges Claude, Paris, France

[21] Appl. No.: 847,310

[22] Filed: Mar. 6, 1992

[30] Foreign Application Priority Data

Mar. 6, 1991 [FR] France ..... 91 02661

[51] Int. Cl.[5] ..... C21C 5/48

[52] U.S. Cl. ..... 266/220; 266/217; 266/275

[58] Field of Search ..... 266/275, 217, 220

[56] References Cited

U.S. PATENT DOCUMENTS 5,054,749 10/1991 Weisang et al. ..... 266/275

FOREIGN PATENT DOCUMENTS 0404641 12/1990 European Pat. Off. .
2243200 3/1974 Fed. Rep. of Germany .
2642679 8/1990 France .
59-125249 7/1984 Japan .
2022228 12/1979 United Kingdom .

*Primary Examiner*—Scott Kastler
*Attorney, Agent, or Firm*—Young & Thompson

[57] ABSTRACT

The invention relates to a tundish for the continuous casting of steel having a housing for the injection of gas with a feed tube for gas, the injection housing having an upper wall which is permeable to the gas. Periodically, the injection housing is completely replaced by removing the sealing grout.

6 Claims, 1 Drawing Sheet

TUNDISH FOR THE CONTINUOUS CASTING OF STEEL

The present invention relates to a tundish for the continuous casting of steel, which serves to distribute the liquid metal toward a plurality of casting lines operating simultaneously. So as to meet the growing requirements of technicians as to the quality of the cast products, steel metallurgists have used the tundish as a metallurgical device which permits rendering uniform the temperature and the composition of the liquid metal and to eliminate all or a portion of the remaining inclusions. To this end, numerous studies have permitted improving the flow of the liquid metal by modifying the geometry and adding barriers (weirs, baffles . . . ) It has been shown that injections of inert gas complete the means now used to improve the metallurgy of the tundish. Although insert gas injection into a liquid metal is now very widely used for ladle metallurgy, the characteristics required for a gas injector in a tundish are different, because, in addition to metallurgical considerations, there are safety considerations and the limitations of cost. For these reasons, the techniques utilized in a ladle are not directly transferable. Thus, metallurgical considerations require the delivery of the finest possible gas bubbles, over a large injection surface and with the best possible distribution. Moreover, this injector must be easy to emplace and be adapted to be replaced so as not substantially to increase the cost of use with the tundish. The increased cost arising from this technique depends on the tonnage cast (from 30 to 3,000 tons as a function of the machines and the length of the operations). As the tundish is normally at the height of the head above the casting floor, so as to permit access to the ingot molds, for the safety of the personnel all risk of performation must absolutely be avoided.

The applicants assignee has already proposed in U.S. Pat. No. 5,054,749 a tundish for the continuous casting of steel, comprising a permanent refractory cast in a sheet metal shell comprising the external wall of the tundish, and on which is deposited a refractory wear lining, within the mass of said permanent refractory, gas injection means comprising a portion extending to the level of the bottom of the tundish and a gas distribution chamber, of which an upper wall for gaseous diffusion is flush with the external surface of the permanent refractory of the tundish, with this particularity that the gas distribution chamber is permanently sealed in a recess in the refractory of the tundish, with a replaceable part in case of wear, in the form of a refractory wear plate having gas permeability, surmounting said gas distribution chamber.

This type of gas injection means gives complete satisfaction from the standpoint of metallurgical treatment, but it has the drawback of difficult replacement of the upper diffusion plate. Thus, this latter must be sealed on the distributor chamber, if only to ensure its retention in place when the gas under pressure is admitted and the operation of unsealing the replaceable diffusion plate, which must be performed at practically every teeming into the tundish of a new charge of liquid metal, leads to rapid deterioration of the chamber permanently embedded in the refractory of the tundish, which leads to disturbance of the gas diffusion and to risks of perforation of the bottom of the tundish by infiltrations of liquid metal.

The present invention has for its object a tundish for the continuous casting of steel, provided with gas diffusion means which is easy to recondition without imposing disturbances in the gas diffusion operation or risks of perforation, and these objects of the invention are achieved in that the tundish comprises, in a metallic shell, a lining of permanent refractory having a lower portion and covered with a refractory wear lining and, in the lower portion of the permanent lining, gas injection means, the lower portion comprising an inwardly opening recess, the gas injection means comprising a unitary injector assembly of refractory material removably sealed in the recess, comprising an upper wall permeable to gas and side and bottom walls impermeable to gas, and defining an internal chamber having a lateral access opening for connection to a feed tube for gas.

It thus develops that it is easier to change completely the injection means temporarily sealed in the refractory of the tundish, than to change only the upper gas diffusion plate. This desirable result flows from the fact that it is altogether possible to seal temporarily an assembly in the refractory mass, wherein damage resulting from unsealing the gas diffusion means can be easily repaired when combining with the sealing grout a new injection means.

BRIEF DESCRIPTION OF THE DRAWINGS

The invention will now be illustrated by three embodiments given by way of example with reference to the accompanying drawings, in which:

Referring to FIG. 1, a tundish 1 is comprised by a refractory lining 2 cast between a sheet metal shell 3 and a formwork (not shown).

Figure 1:
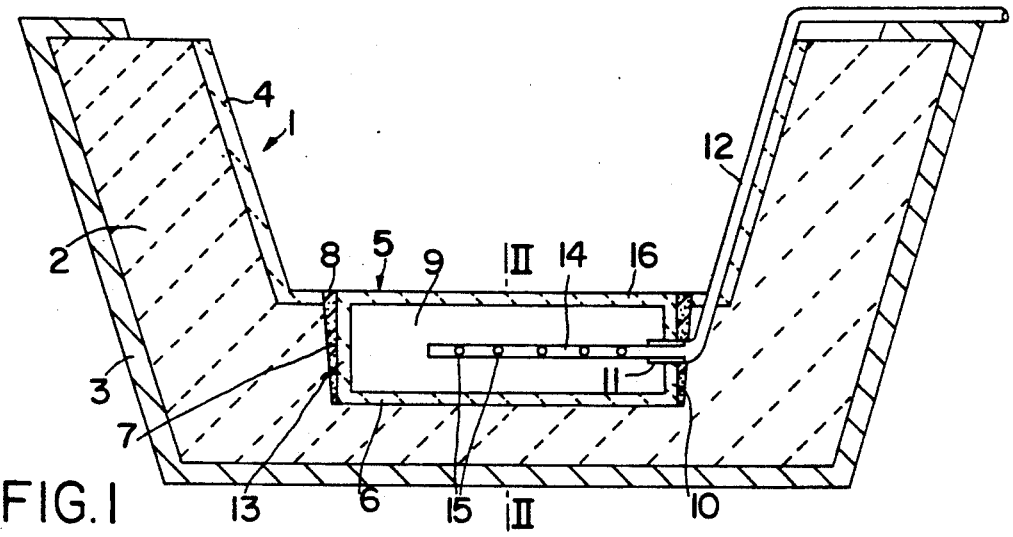
FIG. 1 is a transverse cross sectional view of a tundish according to the invention.

After setting and drying, this refractory "concrete" 2 constitutes a thermal insulation layer and avoids any risk of penetration of liquid metal. Before each use of the tundish, a layer of "gunning" refractory 4 is projected on this latter and constitutes the wear layer. It is eliminated after the end of each cycle when the tundish is inverted to expel the rest of the metal which has solidified.

According to the invention, the injection means 5 is constituted by an injection housing of ceramic or refractory material 6 disposed in a recess 7 provided in the bottom of the permanent refractory concrete 2 and temporarily sealed with a mortar 8 ensuring good cohesion with this permanent refractory 2. The height of refractory concrete below the injector is sufficient to avoid any risk of perforation if liquid metal enters into a space left free by the injector used.

The injection housing 5 is disposed across the transverse extent of the bottom of the tundish 1 and extends over almost all this transverse extent. The tundish 1 can be provided with several injectors 5, spaced from each other in this same transverse direction. The width of an injector is sufficient, typically greater than 4 cm, to ensure the effectiveness of the procedure.

The injection housing 5 has an internal chamber 9 of elongated shape whose one lateral wall 10 comprises a connection 11 for a gaseous feed tube 12 which extends toward the exterior, to the interior of the tundish, and a tubular portion 14 open at its free end and pierced longitudinally by small openings 15, such as holes or slots or slits, to ensure a gas distribution as uniform as possible in the chamber 9 comprising the distribution chamber, the portion 14 extending across the width of the tundish to a certain distance from the opposite end wall 13 of the injector.

To effect the injection itself of the gas into the liquid metal of the tundish, the upper wall 16 of the injector 5 is permeable to gas.

Figure 2:
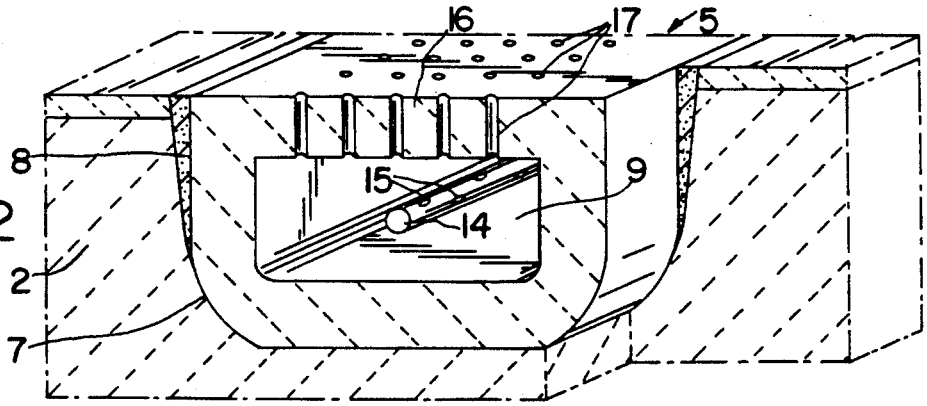
FIGS. 2, 3 and 4 are fragmentary views, on an enlarged scale, of a transverse cross section of different embodiments of gas injection means.
Figure 3:
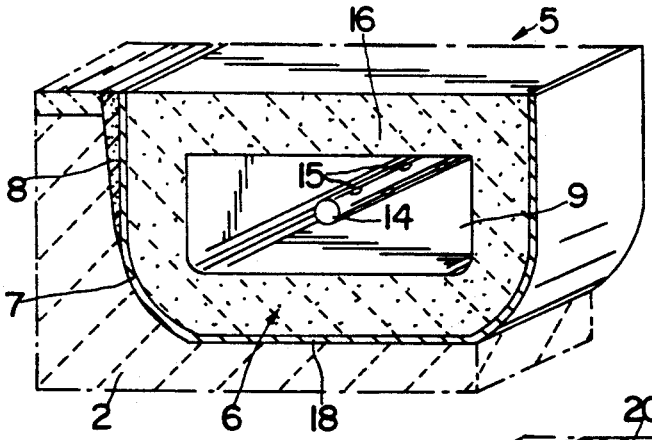
Figure 4:
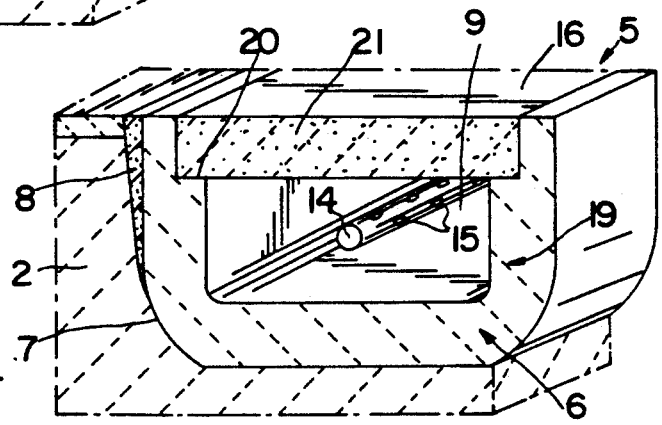

This is ensured:

- either, according to FIG. 2, by forming the injector 5 of a single piece of refractory material which is non-porous and forming small through holes 17 in only the upper wall 16 of the injector 5;
- or, according to FIG. 3, by making the injector 5 of a single piece of porous refractory material and by providing an external fluidtight refractory coating 18 on the side and bottom walls, except the upper wall 16 which therefore remains porous;
- or, according to FIG. 4, by providing an injection chamber 19 of non-porous refractory material, with an upper edge 20 adapted to receive permanently and finally sealed thereon an upper plate 21 of porous refractory material.

The porous refractory material used is of the same type as that of porous plugs used in gas metallurgy comprised by a mixture of refractory grains of fixed granulometric distribution shaped and sintered at high temperature, or a refractory whose porosity has been achieved by adding to the raw slip a product which disappears during firing.

No matter what the type chosen, the injector 5, temporarily sealed by mortar 8 in the recess 7, is periodically replaced by a new injector and to this end it is completely unsealed by removing the mortar 8.

By way of example, an injector has been placed and sealed in the bottom of a tundish, before gunning. During the gunning operation, the injector is protected by a plate. Argon was injected with a flow rate varying from 10 to 100 Nl/min. During the entire duration of casting (45 minutes) the flow is maintained at a constant value. It was noted that the wear on the injector was slight, so that it was necessary to replace it only after several operations of filling the tundish.

What is claimed is:

1. Tundish defining an inner space for the continuous casting of steel comprising, in a metal shell, a permanent refractory lining having a bottom portion and covered with a refractory wear lining and, in a portion of the bottom of the permanent lining, gas injection means, the bottom portion comprising a recess opening outwardly, the gas injection means comprising a unitary injector assembly of refractory material removably sealed in the recess, comprising an upper wall permeable to gas and side and bottom walls impermeable to gas, and defining an internal chamber having a lateral access opening for connection to a feed tube for gas, said upper wall delimiting and being exposed to a lower part of said inner space.

2. Tundish according to claim 1, wherein the injector assembly is formed from a single piece of material impermeable to gas, the upper wall being formed with perforations for gas injection.

3. Tundish according to claim 1, wherein the injector assembly is formed from a single piece of material permeable to gas and covered externally with a coating impermeable to gas except for the upper wall.

4. Tundish according to claim 1, wherein the injector assembly is formed from a casing of material impermeable to gas on which is permanently secured an upper wall of material permeable to gas.

5. Tundish according to claim 1, wherein the injector assembly comprises a gas distribution tube connected to the lateral access opening and extending into the internal chamber.

6. Tundish according to claim 1, wherein the recess and the injector assembly extends over substantially all of the transverse extent of the bottom portion of the permanent lining.

* * * * *